US005735297A

United States Patent [19]

Litton

[11] Patent Number: 5,735,297

[45] Date of Patent: Apr. 7, 1998

[54] CONTAINER MADE OF CURVED PLANES IN OPPOSITION

[75] Inventor: Garfield Litton, Glenrock, N.J.

[73] Assignee: Revlon Consumer Products Corporation, New York, N.Y.

[21] Appl. No.: 640,983

[22] Filed: Apr. 29, 1996

[51] Int. Cl.[6] ..... A45D 33/24; A45D 33/26

[52] U.S. Cl. ..... 132/294; 132/293; 132/295; 132/296; 206/581; 206/823

[58] Field of Search ..... 132/293, 294, 132/295, 296, 305; 220/4.22, 4.24, 608, DIG. 13; 206/581, 823

[56] References Cited

U.S. PATENT DOCUMENTS

| | | | |
|---|---|---|---|
| D. 145,100 | 6/1946 | Muller-Munk | D86/10 |
| D. 236,037 | 7/1975 | McCarthy | D5/6 |
| D. 337,177 | 7/1993 | Tiramani | D28/76 |
| 1,518,071 | 12/1924 | Fioret | 132/295 |
| 1,874,433 | 8/1932 | Briggs | 132/296 |
| 4,781,288 | 11/1988 | Wing | 132/293 |
| 4,834,122 | 5/1989 | Yuhara et al. | 132/293 |
| 5,020,673 | 6/1991 | Adams | 206/581 |
| 5,107,871 | 4/1992 | Butcher et al. | 132/296 |
| 5,135,012 | 8/1992 | Kamen et al. | 132/294 |

*Primary Examiner*—John J. Wilson
*Assistant Examiner*—Pedro Philogene
*Attorney, Agent, or Firm*—Julie Blackburn

[57] ABSTRACT

A container having a first surface comprised of a plane having a center, and a first edge and second edge in opposition, which first and second edges are curved downward from the center at an angle of 1 to 90 degrees, and a second surface comprised of a plane having a center, and a first edge and second edge in opposition, which first and second edges are curved upward from the center at an angle of 1 to 90 degrees, and sidewalls interposed between said first and second surfaces.

18 Claims, 7 Drawing Sheets

CONTAINER MADE OF CURVED PLANES IN OPPOSITION

TECHNICAL FIELD

The invention is in the field of containers, and in particular, containers for holding cosmetic products.

BACKGROUND OF THE INVENTION

Many containers and utensils are now being made ergonomically, so that they interact as comfortably as possible with the user. There is a particular need to make containers for cosmetics and personal care products ergonomic. Cosmetic users, for example, are very prone to dropping bottles or compacts, and if such items can be constructed in such a way as to make the items easier and more comfortable to hold and use it enhances product attractiveness. At the same time the ergonomic construction must be easy and inexpensive to mold otherwise the compact container will be expensive to make.

It has most unexpectedly been discovered that orienting two curved planes together to form a compact case provides a structure which is easily held in the palm. When the plane forming the top of the compact case is opened, the curved configuration of the lid enables it to be easily cradled in the index finger.

SUMMARY OF INVENTION

The invention is directed to a container having a first surface comprised of a plane having a center, and a first edge and a second edge in opposition, which first and second edges are curved downward from the center at an angle of 1 to 90 degrees, and a second surface comprised of a plane having a center, and a first edge and a second edge in opposition, which first and second edges are curved upward from the center at an angle of 1 to 90 degrees, and sidewalls interposed between said first and second surfaces.

DETAILED DESCRIPTION

Figure 1:
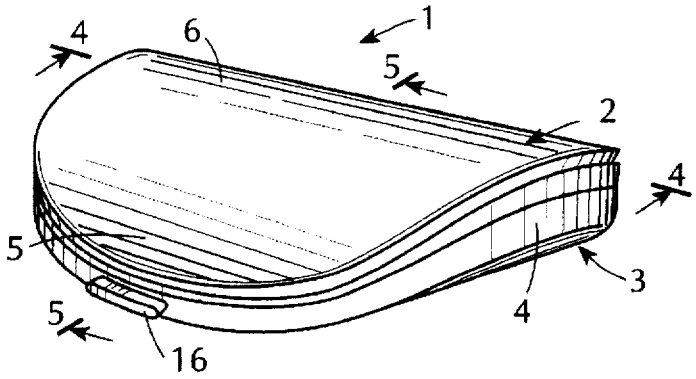
FIG. 1 is a front perspective view of a compact case containing a mid-section which folds up and down.
Figure 2:
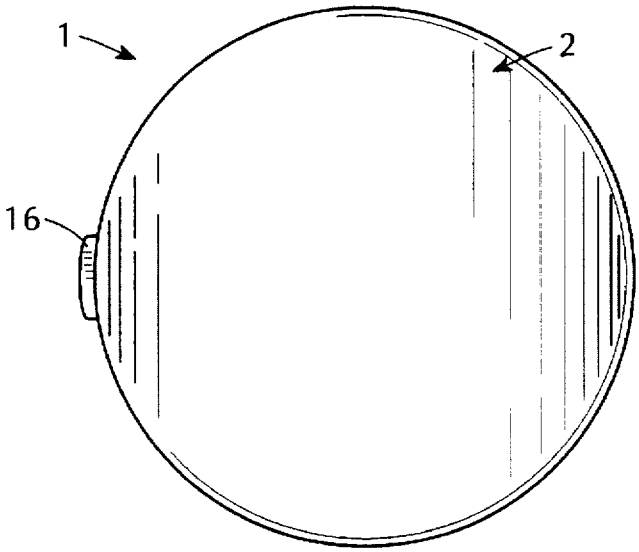
FIG. 2 is a top plan view of the compact of FIG. 1 in the closed position.
Figure 3:
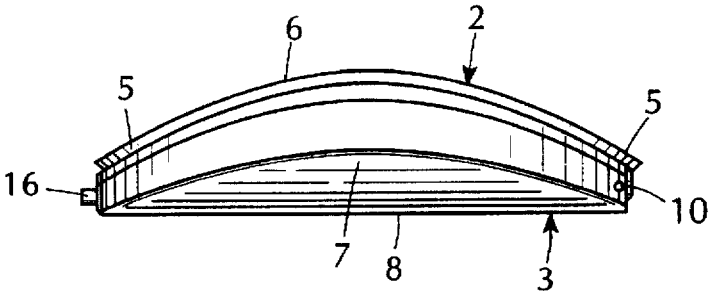
FIG. 3 is a right lateral view of the compact of FIG. 1 in the closed position.
Figure 4:
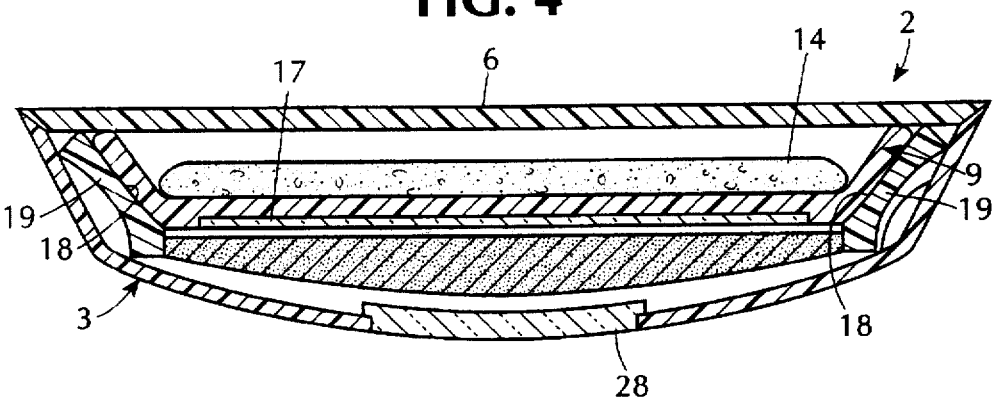
FIG. 4 is a cross-sectional view taken across line 4—4 of the compact of FIG. 1.
Figure 5:
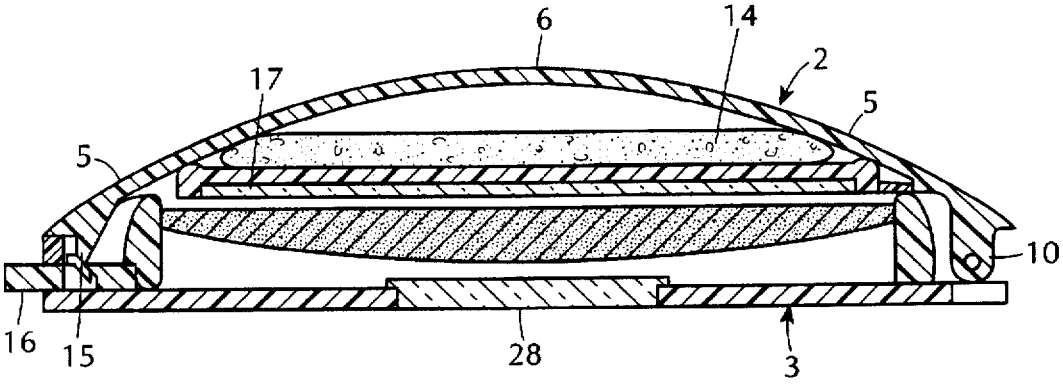
FIG. 5 is a cross-sectional view taken across line 5—5 of the compact of FIG. 1.
Figure 7:
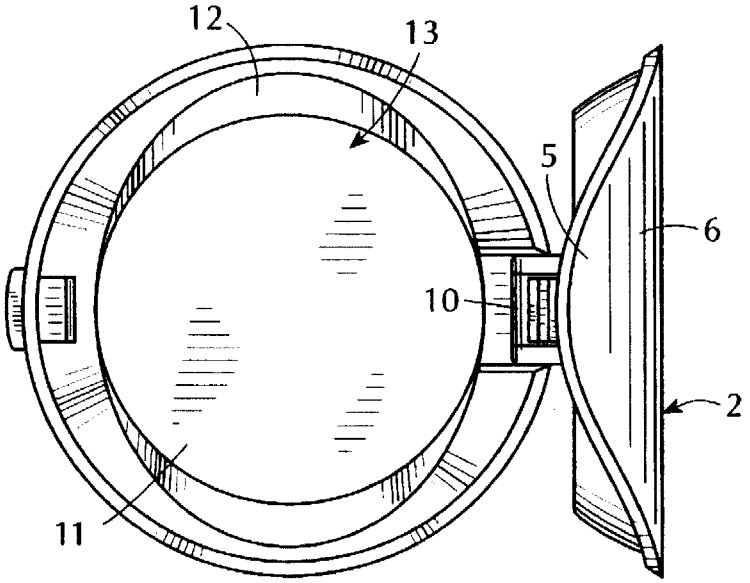
FIG. 7 is a top plan view of the compact of FIG. 1 in the open position with the mid-section folded up.
Figure 6:
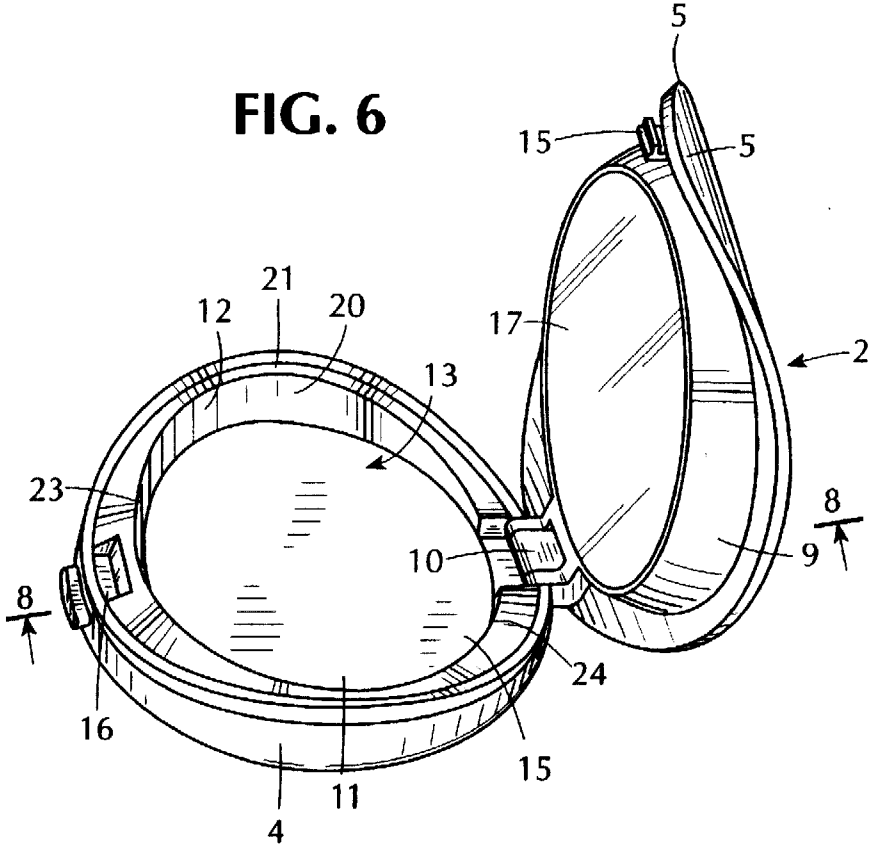
FIG. 6 is a front perspective view of the compact of FIG. 1 in the open position with the mid-section folded up.
Figures 8, 10:
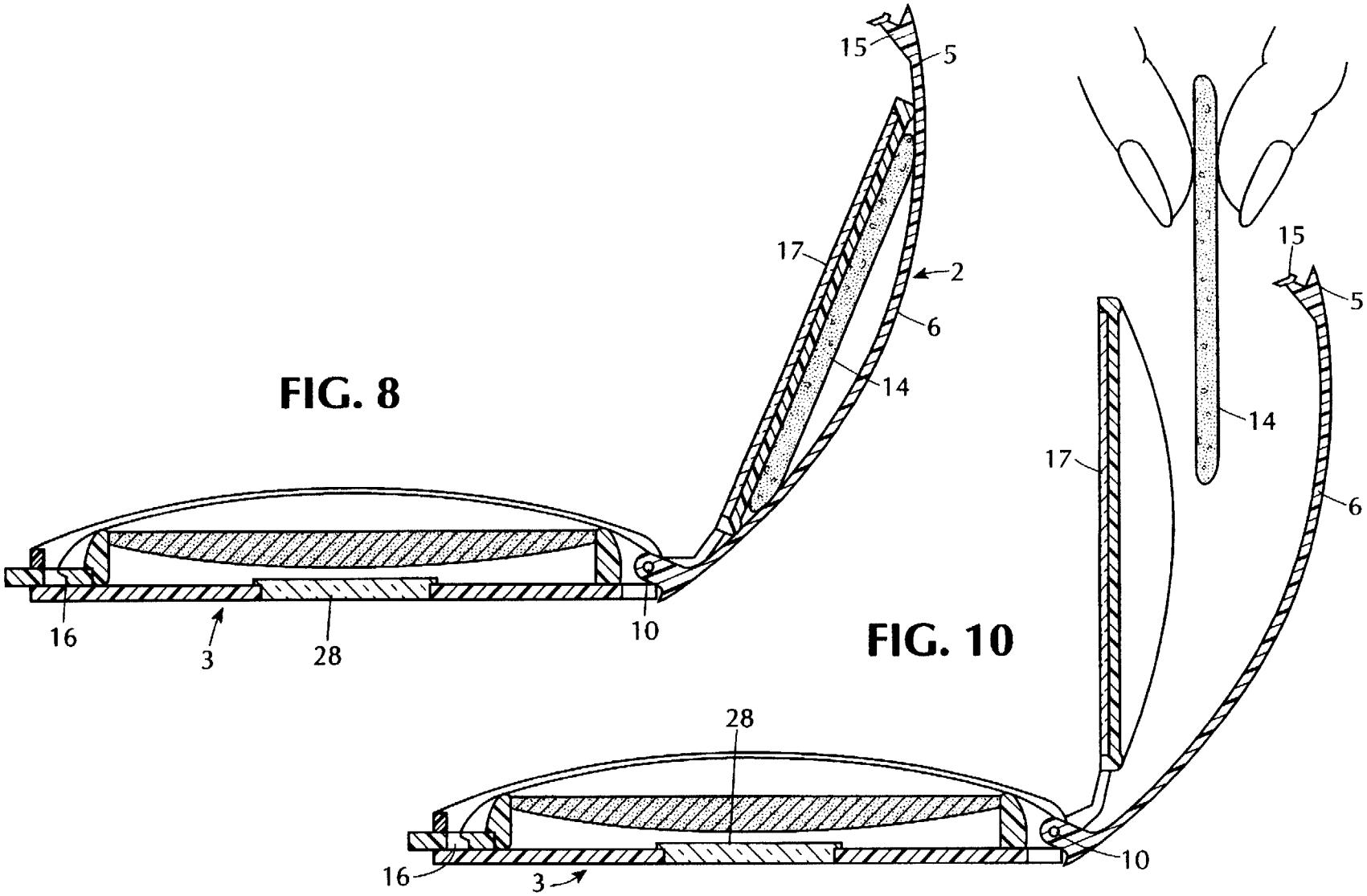
FIG. 8 is a cross-sectional view taken across line 8—8 of the compact of FIG. 6.
FIG. 10 is a cross-sectional view taken across line 8—8 of the compact of FIG. 6 with the mid-section folded down and illustrating the placement of a cosmetic sponge in the cavity found in the top mid-section.
Figure 11:
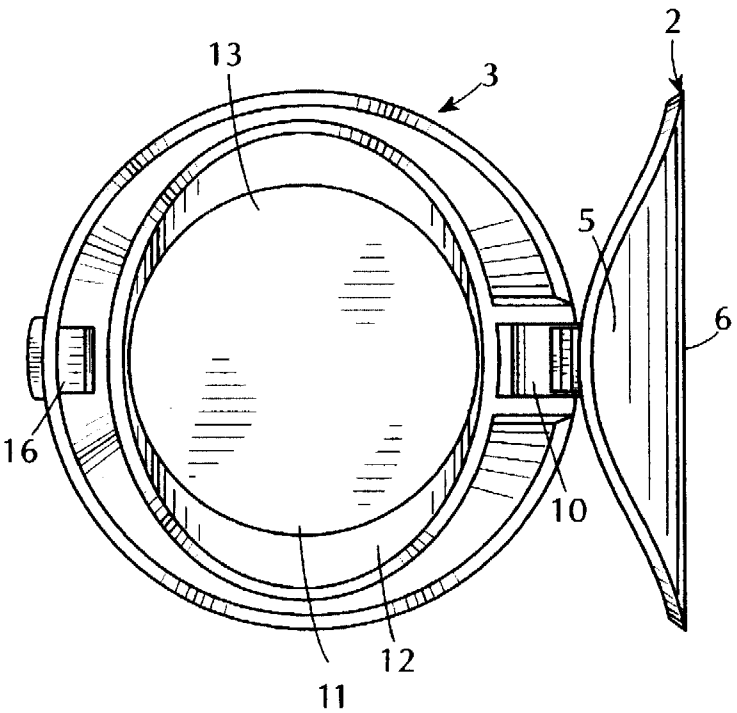
FIG. 11 is a top plan view of the compact of FIG. 1 in the open position with the mid-section folded down.
Figure 9:
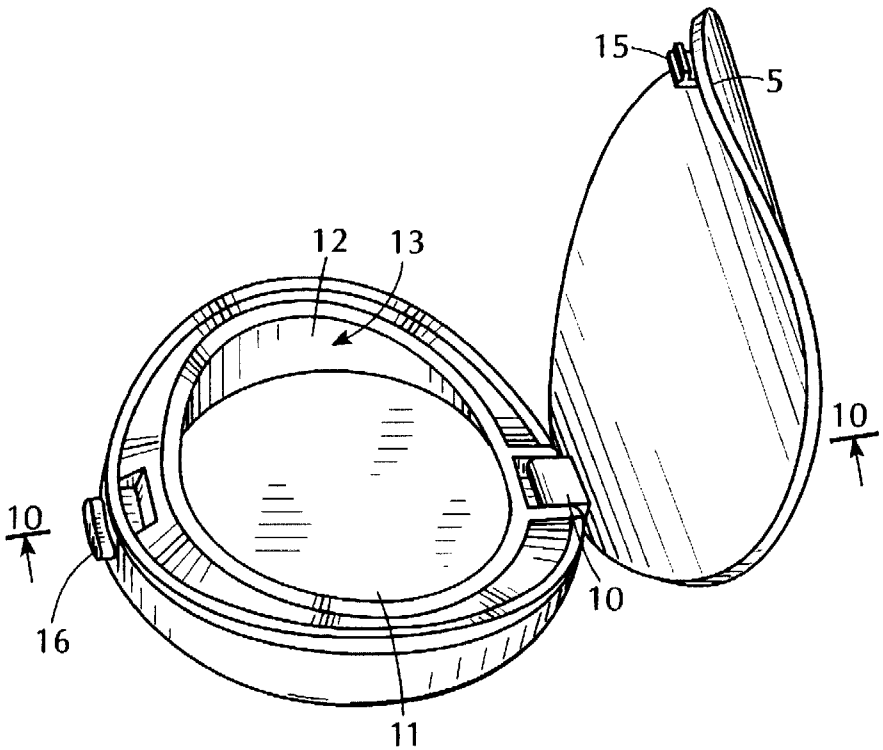
FIG. 9 is a top perspective view of the compact of FIG. 1 in the open position with the mid-section folded down, illustrating the cavity for holding a cosmetic sponge or other type of applicator.

One preferred embodiment of the invention is a compact case for containing cosmetic and an applicator 1 as illustrated in FIGS. 1–11. Although this compact case exhibits a generally round shape, the compact case in accordance with the invention could just as easily be square, rectangular, octagonal, or in some other type of configuration. The compact case comprises a first surface which is a top or lid 2, a second surface which is a bottom 3, and sidewalls 4, which are preferably perpendicular to the top 2 and bottom 3. The top 2 of the compact case is comprised of a plane curving downwardly 5 from the center 6 of the top at an angle of approximately 1 to 90 degrees, preferably 5 to 45 degrees. The bottom 3 of the compact case is a plane curving upwardly 7 from the center 8. Preferably the downward curve of the top 2 and the upward curve of the bottom 3 are the same. In the most preferred embodiment of the invention the top and bottom are identical in size, shape, and curvature. The surfaces are juxtaposed to make the compact by first aligning the surfaces, then flipping one surface over and rotating it 90 degrees as illustrated in FIGS. 1–11. FIG. 11 illustrates the compact case in an open position with the top 2 illustrating the downward curve 5 of the edge from the center 6. The top or lid 2 is attached to the mid-section 9 and the bottom 3 by a hinge 10, and the mid-section 9 is in the down position. The mid-section 9 is a flat planar surface 11, with upwardly curving edges 12 which form a cavity 13 for containing a cosmetic sponge 14 or other type of applicator as illustrated in FIGS. 4, 5, and 10. FIGS. 6 and 7 illustrate the compact of FIG. 1 in the open position with the mid-section 9 folded up. A clasp 15 is affixed to the top 2 of the compact which engages an engagement means 16 on the bottom 3 of the compact. A mirror 17 is affixed to the bottom of the mid-section. The bottom 3 of the compact contains a cavity 18 for containing cosmetic. This cavity 18 has sidewalls 19 of size and dimension sufficient to permit the mid-section 9 to nest within the cavity 18 on top of the cosmetic when the mid-section 9 is folded down or when the compact 1 is in the closed position. It is preferred that the sidewalls 19 are of varying dimension such that the sidewalls are higher 20 at the side 21 of the compact and lower 22 at the front 23 and rear 24 of the compact 1. When the compact 1 is in the open position as seen in FIG. 6, and held in the users hand, the top 2 of the compact nests very comfortably in the index finger of the user. The bottom 3 of the compact rests very comfortably in the user's palm following its natural shape.

The bottom 3 of the compact 1 may have a view window 28 which is a clear window enabling the consumer to see the color of cosmetic contained within the compact 1.

FIG. 8 illustrates a cross section of the compact 1 taken across line 8—8 of FIG. 6. FIG. 10 illustrates a cross-section of the compact 1 taken across line 10—10 of FIG. 9. Both figures illustrate the downward curve 5 of the top 2.

Figure 12:
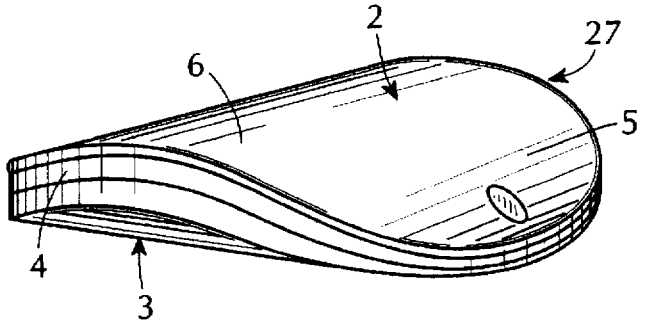
FIG. 12 is a front perspective view of another type of compact within the scope of the invention which is in the closed position.
Figure 13:
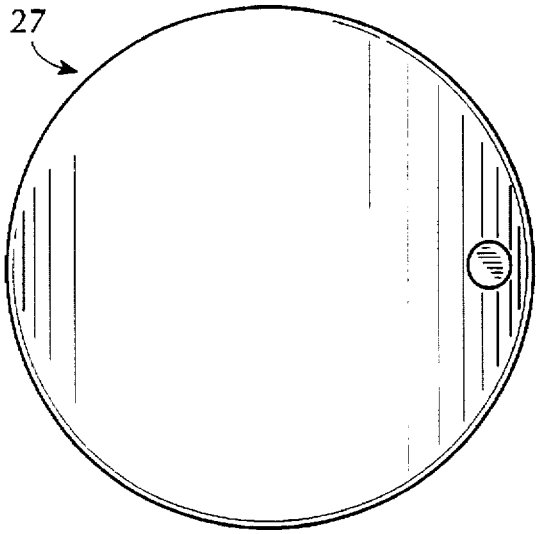
FIG. 13 is a top plan view of the compact of FIG. 12 in the closed position.
Figure 14:
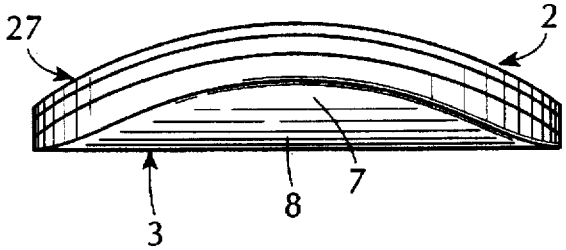
FIG. 14 is a side elevational view of the compact of FIG. 12 in the closed position.
Figure 15:
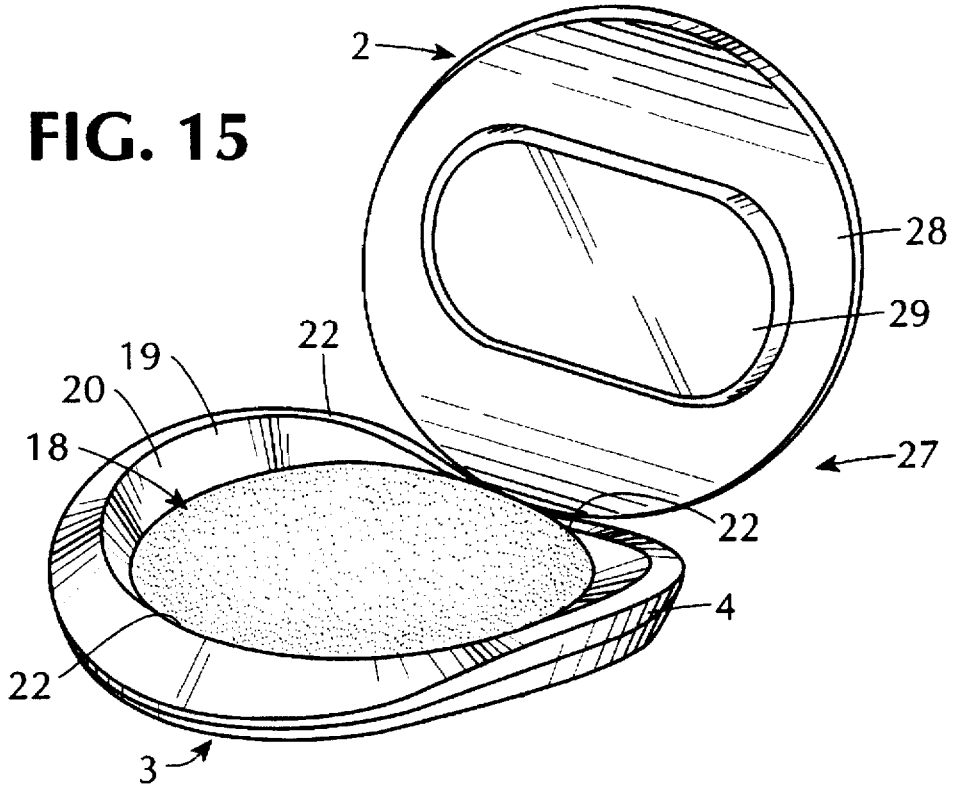
FIG. 15 is a front perspective view of the compact of FIG. 12 in the open position.
Figure 16:
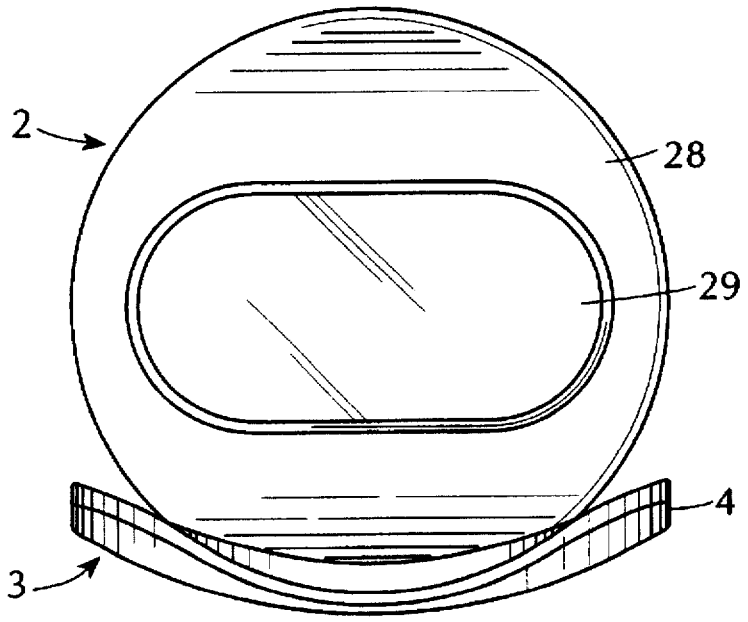
FIG. 16 is a front elevational view of the compact of FIG. 12 in the open position.

FIGS. 12–16 illustrate another embodiment of the invention, in particular a cosmetic compact which does not contain mid-section 9. FIG. 12 illustrates the compact 27 in the closed position. This compact 27 has a first surface which is a top 2 and a second surface which is a bottom 3, and sidewalls 4. Preferably the sidewalls 4 are perpendicular to the first and second surfaces. The top 2 curves downwardly 5 at an angle of 1 to 90, preferably 5 to 45 degrees from the center 6. The bottom 3 curves upwardly 8 at an angle of 1 to 90, preferably 5 to 45 degrees from the center 8. Preferably the downward curve 5 and the upward curve 8 of the top 2 and bottom 3 respectively, are the same. FIG. 15 illustrates the compact 27 in the open position. The inner surface 28 of the top 2 may contain a mirror 29. The bottom 3 contains a cavity 18 for cosmetic. Preferably the cavity 18 has sidewalls 19 of a size and dimension such that the sidewalls 20 are taller on the side of the compact and shorter 22 at the front and rear of the compact 27.

We claim:

1. A container having a first surface comprised of a plane having a center, and a first edge and second edge in opposition, which first and second edges are curved downward from the center at an angle of 1 to 90 degrees, and a second surface comprised of a plane having a center, and a first edge and a second edge in opposition, which first and second edges are curved upward from the center at an angle of 1 to 90 degrees, and sidewalls interposed between, and perpendicular to, said first and second surfaces, the sidewalls being of varying dimensions such that they are higher at the sides of the compact and lower at the front and rear of the compact.

2. The container of claim 1 wherein said first surface and said second surface are identical in size, shape, and curvature.

3. The container of claim 1 wherein said first surface and said second surface are parallel to each other.

4. The container of claim 1 wherein the first surface is rotated approximately 90 degrees with respect to the second surface.

5. The container of claim 4 which is a cosmetic compact.

6. The container of claim 5 wherein the first and second edges of said first surface curve downward at an angle of 5 to 45 degrees.

7. The container of claim 6 wherein the first and second edges of said second surface curve upward at an angle of 5 to 45 degrees.

8. The container of claim 7 wherein the downward curve of the first surface and the upward curve of the second surface are identical.

9. The container of claim 4 wherein one surface contains a window which permits viewing of the cosmetic.

10. The container of claim 4 which contains a hinge.

11. The container of claim 4 containing a closure means which permits interlocking of said first and second surfaces.

12. The container of claim 4 wherein the sidewalls are affixed to said second surface to form a cavity.

13. The container of claim 12 wherein cosmetic is contained in the cavity.

14. The container of claim 4 containing a third plane interposed between said first and second surfaces and attached to said first and second surfaces by means of a hinge.

15. The container of claim 14 wherein a mirror is affixed to said third plane.

16. The container of claim 4 which is round.

17. The container of claim 4 which is square.

18. The container of claim 4 which is rectangular.

* * * * *